US005842912A

United States Patent [19]

Holzapfel et al.

[11] Patent Number: 5,842,912

[45] Date of Patent: Dec. 1, 1998

[54] APPARATUS FOR CONDITIONING POLISHING PADS UTILIZING BRAZED DIAMOND TECHNOLOGY

[75] Inventors: Paul Holzapfel, Chandler; Thomas K. Crosby; Richard J. Kruse, both of Gilbert; Larry Biddlingmeier; Jim Schlueter, both of Phoenix, all of Ariz.

[73] Assignee: Speedfam Corporation, Chandler, Ariz.

[21] Appl. No.: 683,571

[22] Filed: Jul. 15, 1996

[51] Int. Cl.[6] ..... B24B 7/00; B24B 29/02

[52] U.S. Cl. ..... 451/72; 451/288; 451/443; 451/540; 125/3; 125/8

[58] Field of Search ..... 51/295; 125/3, 125/4, 8; 451/56, 23, 72, 159, 163, 174, 285–290, 443, 540

[56] References Cited

U.S. PATENT DOCUMENTS

| | | | |
|---|---|---|---|
| 3,894,673 | 7/1975 | Lowder et al. . | |
| 4,018,576 | 4/1977 | Lowder et al. . | |
| 4,805,348 | 2/1989 | Arai et al. . | |
| 5,037,704 | 8/1991 | Nakai et al. . | |
| 5,099,614 | 3/1992 | Arai et al. . | |
| 5,329,732 | 7/1994 | Karlsrud et al. . | |
| 5,456,627 | 10/1995 | Jackson et al. . | |
| 5,486,131 | 1/1996 | Cesna et al. | 451/56 |
| 5,498,196 | 3/1996 | Karlsrud et al. | 451/11 |
| 5,498,199 | 3/1996 | Karlsrud et al. | 451/289 |
| 5,569,062 | 10/1996 | Karlsrud | 451/285 |

FOREIGN PATENT DOCUMENTS 1462510 6/1974 United Kingdom .

OTHER PUBLICATIONS

Bulletin for Abrasive Technology, Inc. entitled "Technical Bulletin P.B.S.® vs. Electroplating", undated.

U.K. Patent Application No. 28879/74, Filed 28 Jun. 74, entitled "Method of Making Abrasive Tools".

Patent Abstracts of Japan, vol. 012, No. 201 (M–707), 10 Jun. 1988 (abstract of JP 63 007270 (Brother Ind. Ltd.), 13 Jan. 1988).

*Primary Examiner*—Timothy V. Eley
*Attorney, Agent, or Firm*—Snell & Wilmer

[57] ABSTRACT

A conditioning ring having cutting elements brazed-bonded to the bottom surface of the ring and suitably adopted for conditioning a workpiece polishing pad by contact with the pad. The conditioning ring further includes a flange extending about the bottom periphery of the ring with the cutting elements being attached to the bottom surface of the flange. The flange includes cutout portions for permitting material to escape from the interior of the ring. The cutting elements are distributed substantially uniformly across the bottom surface of the flange and the elements are brazed-bonded to the flange with a braised metal alloy, creating an extremely strong bond between the cutting elements and the flange surface. Further, the conditioning ring may be attached to a plurality wafer carrier elements so that the conditioning process occurs during the actual polishing of the wafers, or the conditioning ring may be attached to a mechanical arm which engages the ring against the polishing pad in between wafer polishing steps. In either case, to enhance the conditioning process, the carrier element and the mechanical arm rotates the ring about its axis and oscillates the ring back and forth across the polishing pad.

7 Claims, 6 Drawing Sheets

APPARATUS FOR CONDITIONING POLISHING PADS UTILIZING BRAZED DIAMOND TECHNOLOGY

TECHNICAL FIELD

The present invention relates, generally, to methods and apparatus for polishing or planarizing workpieces such as semiconductor wafers, and more particularly, to a device for conditioning the polishing pads used for the planarization of the workpieces.

BACKGROUND ART AND TECHNICAL PROBLEMS

The production of integrated circuits begins with the creation of high-quality semiconductor wafers. During the wafer fabrication process, the wafers may undergo multiple masking, etching, and dielectric and conductor deposition processes. Because of the high-precision required in the production of these integrated circuits, an extremely flat surface is generally needed on at least one side of the semiconductor wafer to insure proper accuracy and performance of the microelectronic structures being created on the wafer surface. As the size of the integrated circuits continues to decrease and the number of microstructures per integrated circuits increases, the need for precise wafer surfaces becomes more important. Therefore, between each processing step, it is usually necessary to polish or planarize the surface of the wafer to obtain the flattest surface possible.

For a discussion of chemical mechanical planarization (CMP) processes and apparatus, see, for example, Arai, et al., U.S. Pat. No. 4,805,348, issued February, 1989; Arai, et al., U.S. Pat. No. 5,099,614, issued March, 1992; Karlsrud et al., U.S. Pat. No. 5,329,732, issued July, 1994; Karlsrud, U.S. Pat. No. 5,498,196, issued March, 1996; and Karlsrud et al., U.S. Pat. No. 5,498,199, issued March, 1996.

Such polishing is well known in the art and generally includes attaching one side of the wafer to a flat surface of a wafer carrier or chuck and pressing the other side of the wafer against a flat polishing surface. In general, the polishing surface comprises a polishing pad that has an exposed abrasive surface of, for example, cerium oxide, aluminum oxide, fumed/precipitated silica or other particulate abrasives. Polishing pads can be formed of various materials, as is known in the art, and which are available commercially. Typically, the polishing pad may be a blown polyurethane, such as the IC and GS series of polishing pads available from Rodel Products Corporation in Scottsdale, Ariz. The hardness and density of the polishing pad depends on the material that is to be polished.

During the polishing or planarization process, the workpiece (e.g., wafer) is typically pressed against the polishing pad surface while the pad rotates about its vertical axis. In addition, to improve the polishing effectiveness, the wafer may also be rotated about its vertical axis and oscillated back and forth over the surface of the polishing pad. It is well known that polishing pads tend to wear unevenly during the polishing operation, causing surface irregularities to develop on the pad. To insure consistent and accurate planarization and polishing of all workpieces, these irregularities should either be removed or accounted for.

One method of removing the surface irregularities which develop in the polishing pad is to condition or dress the pad with some sort of roughing or cutting means. Generally this truing or dressing of the polishing pad can occur either while the wafers are being polished (in-situ conditioning), or between polishing steps (ex-situ conditioning). An example of ex-situ conditioning is disclosed in Cesna, et al., U.S. Pat. No. 5,486,131, issued on Jan. 23, 1996, and entitled *Device for Conditioning Polishing Pads.* An example of in-situ conditioning is disclosed in Karlsrud, U.S. patent application Ser. No. 08/487,530, filed on Jul. 3, 1995, and entitled *Polishing Pad Conditioning.* Both the Cesna, et al. patent and the Karlsrud application are incorporated herein by reference.

Generally, in the semiconductor wafer polishing and planarization context, small roughing or cutting elements, such as diamond particles, are used to condition the polishing pads. As shown in the Cesna, et al. patent and the Karlsrud application, both in-situ and ex-situ conditioning apparatus utilize circular ring conditioners which have these cutting elements secured to a bottom flange of the ring. Generally, these cutting elements are secured to the bottom surface of the flange of the carrier ring by an electroplating process, or the like. Electroplating produces a simple mechanical entrapment of the cutting elements on the carrier ring by depositing metal, layer by layer around the cutting elements until they are entrapped.

Generally, this process occurs in two steps. First, the cutting elements are initially attached to the ring substrate by a very thin layer of metal, such as nickel. Second, additional nickel is built-up around the cutting elements layer by layer, holding them in place. During this over-plating or build-up stage, a sufficient amount of nickel must be deposited to capture about 60% to about 80% of the height of the cutting element in order to hold the elements to the ring (See FIG. 11). As a result, many of the cutting elements get embedded so deeply that the metal layer actually covers them, thus making them unavailable for cutting. Moreover, because electroplating does not create a chemical bond with the cutting elements, the elements tend to pull out during conditioning and become lodged in the polishing pad. These dislodged cutting elements may then scratch and destroy the wafers during the polishing process. Finally, because it is very difficult to control the placement of the cutting elements on the ring during the electroplating process, repeat ability and uniformity of the cutting element distribution on the carrier ring from ring to ring are difficult to control. Therefore, each ring will have a different cut rate and, thus, create a nonuniform pad profile during conditioning.

A new polishing pad conditioning device and method for bonding the cutting elements to the device are therefore needed, which overcome the limitations of the prior art.

SUMMARY OF THE INVENTION

The present invention provides methods and apparatus for conditioning polishing pad devices which overcome many of the shortcomings of the prior art.

In accordance with one aspect of the present invention, a polishing pad conditioning device for conditioning a polishing pad by contact with the pad is configured with cutting elements braze bonded to its bottom surface. The conditioning device also suitably includes a means for engaging the conditioning means with the polishing pad and for rotating the conditioning means on and oscillating the conditioning means over the top surface of the polishing pad.

In accordance with a further aspect of the present invention, the engaging rotating and oscillating means comprises an operating arm adapted for moving the conditioning device into and out of operative engagement with the top surface of the pad, and for oscillating the conditioning device radially over the top surface of the pad. Further, the conditioning device comprises a carrier element configured in the shape of a ring, and having cutting elements attached to the bottom surface of the carrier element in a circular ring configuration.

In accordance with yet a further aspect of the present invention, the carrier element may include a flange which extends about the periphery of the ring, with the cutting elements being attached to the flange.

In accordance with yet a further aspect of the present invention, the flange includes cut out portions to permit materials to escape from the interior of the carrier ring. In accordance with this aspect of the invention, the cutting elements are distributed substantially uniformly along the flange and the elements are braze bonded to the flange with a brazed metal alloy. Preferably, the brazed metal alloy will only cover about 25% to 75%, and preferably about 40–60%, and most preferably about 50% of the height of the cutting elements. For example, for cutting elements (e.g., diamond particles) having an average height (i.e., diameter) in the range of 50 to 200 micrometers and most preferably about 150 micrometers, the brazed metal alloy should preferably cover each cutting element up to about 50% of its height, or up to about 75 micrometers. The present inventors have determined that particle sizes in the range of 50 to 200 U.S. mesh, and most preferably about 100 to 120 U.S. mesh are particularly well adapted to the present invention.

In accordance with a further aspect of the present invention, covering less than 25% to 40% of the height of a cutting element with braze may result in an insufficiently secure bond, such that the cutting elements may break away from the braze, liberating the cutting element and perhaps damaging the workpieces. On the other hand, covering the cutting elements with braze in excess of 60% to 80% of the height of the cutting element may impede the ability of the cutting elements to properly dress or condition a pad. Thus, the present inventors have determined that an optimal range involves covering the cutting elements in braze up to about 50% of the height of the cutting elements.

In accordance with yet a further aspect of the present invention, the conditioning device may be configured to condition the polishing pad at the same time workpieces are being polished. In accordance with this aspect of the invention, the conditioning device preferably is configured to mount to a moveable carrier element, which holds the workpieces during polishing.

In accordance with a further aspect of the present invention, the conditioning device is a ring configured to mount around the outer perimeter of the workpiece carrier element, wherein the cutting elements are securely attached to the bottom surface of the ring in a circular configuration.

In accordance with yet a further aspect of the present invention, the cutting elements may be attached to a flange which extends about the periphery of the ring. In addition, the flange preferably may include cut out portions to permit materials to escape from the interior of the ring.

In accordance with yet another aspect of the present invention, the cutting elements used may comprise different materials, such as, for example, diamond particles, polycrystalline chips/slivers, cubic boron nitrite particles, silicon carbide particles and the like.

BRIEF DESCRIPTION OF THE DRAWING FIGURES

The present invention will hereinafter be described in conjunction with the appended drawing figures, wherein like numerals denote like elements, and:

DETAILED DESCRIPTION OF PREFERRED EXEMPLARY EMBODIMENT

The subject invention relates to an improved apparatus for conditioning workpiece polishing pads, and an improved method for securing cutting elements to the apparatus so that the cutting elements do not dislodge from the apparatus and damage the workpieces being polished. While this invention may be used to condition a large variety of polishing pads which may be used to polish a variety of different types of workpieces, the preferred exemplary embodiments discussed herein will relate to polishing pad conditioning apparatuses used to condition semiconductor wafer polishing pads. It will be understood, however, that the invention is not limited to any particular workpiece polishing pad conditioning environment.

Figure 1:
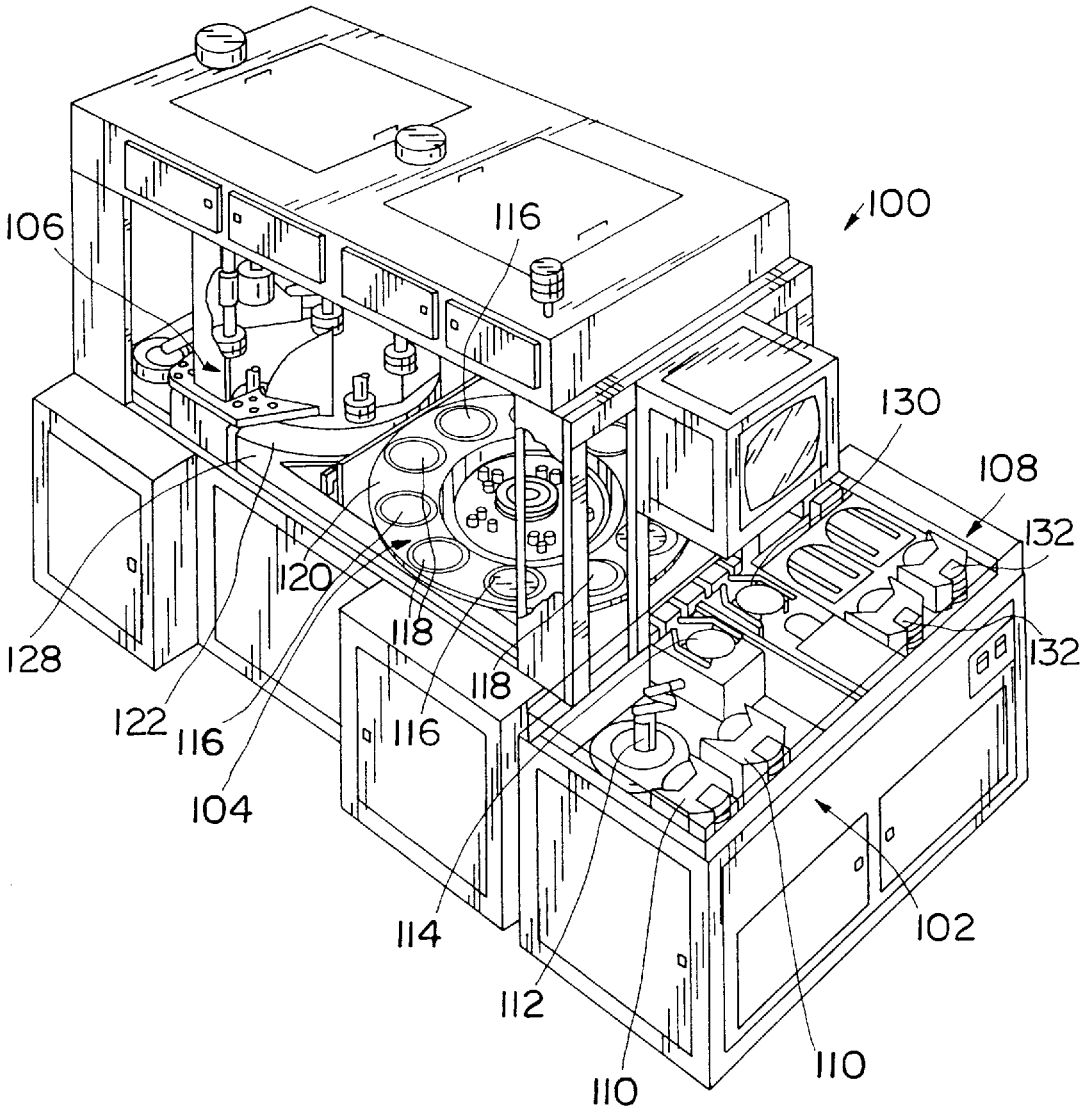
FIG. 1 is a perspective schematic view of a semiconductor wafer polishing and planarization machine currently known in the art.
Figure 2:
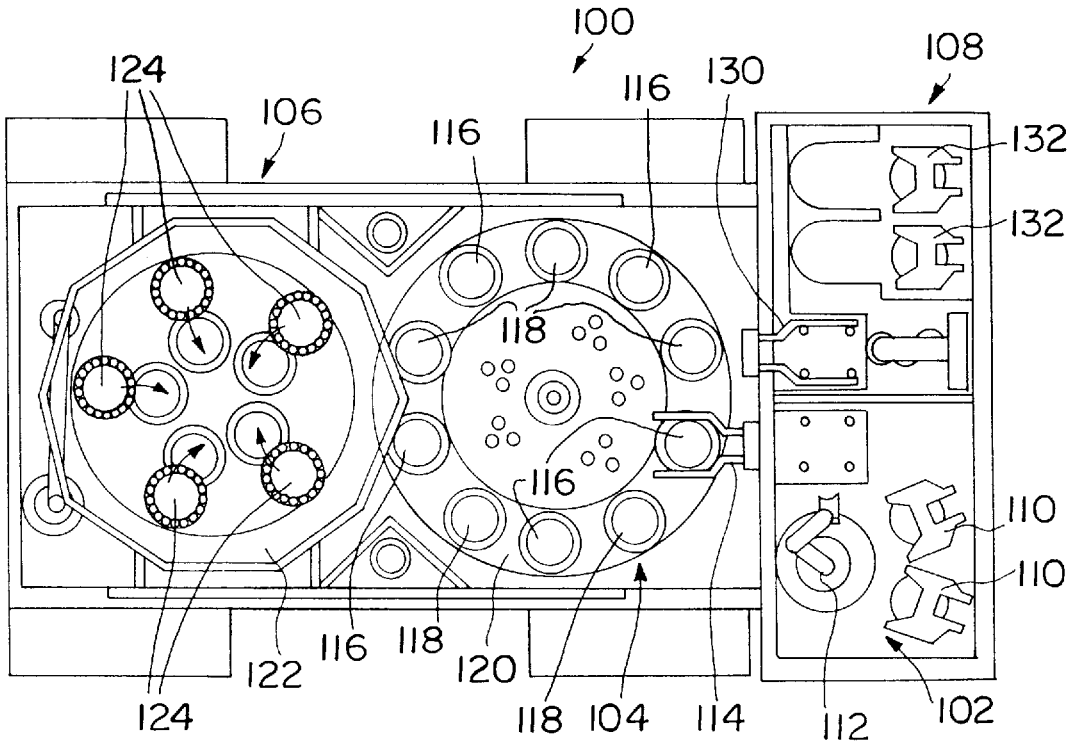
FIGS. 2 and 3 are top cross-sectional views of the wafer cleaning machine shown in FIG. 1 illustrating different parts of the machine at different times in the polishing process.
Figure 3:
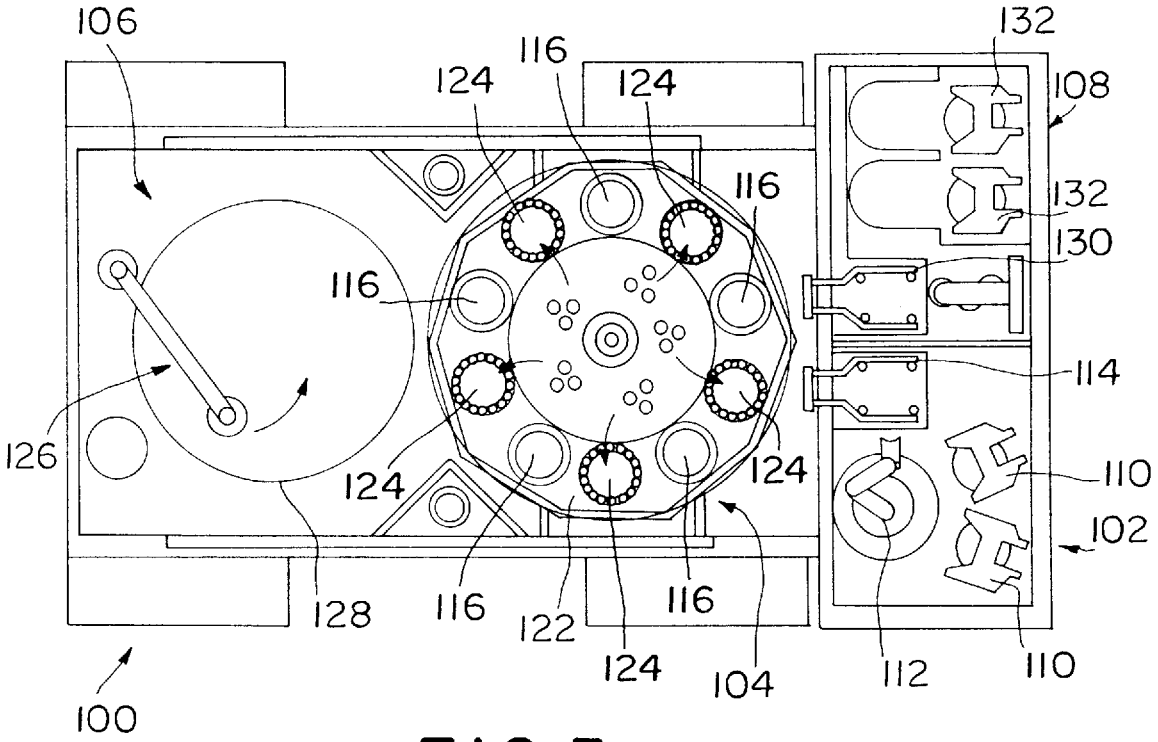

Referring now to FIGS. 1–3, a wafer polishing apparatus 100 is shown embodying the present invention. Wafer polishing apparatus 100 suitably comprises a comprehensive wafer polishing machine which accepts wafers from a previous processing step, polishes and rinses the wafers, and reloads the wafers back into wafer cassettes for subsequent processing.

Discussing now the polishing apparatus 100 in more detail, apparatus 100 comprises an unload station 102, a wafer transition station 104, a polishing station 106, and a wafer rinse and load station 108.

In accordance with a preferred embodiment of the invention, cassettes 110, each holding a plurality of wafers, are loaded into the machine at unload station 102. Next, a robotic wafer carrier arm 112 removes the wafers from cassettes 110 and places them, one at a time, on a first wafer transfer arm 114. Wafer transfer arm 114 then lifts and moves the wafer into wafer transition section 104. That is, transfer arm 114 suitably places an individual wafer on one of a plurality of wafer pick-up stations 116 which reside on a rotatable table 120 within wafer transition section 104. Rotatable table 120 also suitably includes a plurality of wafer drop-off stations 118 which alternate with pick-up stations 116. After a wafer is deposited on one of the plurality of pick-up stations 116, table 120 will rotate so that a new station 116 aligns with transfer arm 114. Transfer arm 114 then places the next wafer on the new empty pick-up station 116. This process continues until all pick-up stations 116 are filled with wafers. In the preferred embodiment of the invention, table 120 will include five pick-up stations 116 and five drop-off stations 118.

Next, a wafer carrier apparatus 122, comprising individual wafer carrier elements 124, suitably aligns itself over table 120 so that respective carrier elements 124 are positioned directly above the wafers which reside in respective pick-up stations 116. The carrier apparatus 122 then drops down and picks up the wafers from their respective stations and moves the wafers laterally such that the wafers are positioned above polishing station 106. Once above polishing station 106, carrier apparatus 122 suitably lowers the wafers, which are held by individual elements 124, into operative engagement with a polishing pad 126 which sits atop a lap wheel 128. During operation, lap wheel 128 causes polishing pad 126 to rotate about its vertical axis. At the same time, individual carrier elements 124 spin the wafers about their respective vertical axis and oscillate the wafers back and forth across pad 126 (substantially along arrow 133) as they press against the polishing pad. In this manner, the surface of the wafer will be polished or planarized.

After an appropriate period of time, the wafers are removed from polishing pad 126, and carrier apparatus 122 transports the wafers back to transition station 104. Carrier apparatus 122 then lowers individual carrier elements 124 and deposits the wafers onto drop-off stations 118. The wafers are then removed from drop-off stations 118 by a second transfer arm 130. Transfer arm 130 suitably lifts each wafer out of transition station 104 and transfers them into wafer rinse and load station 108. In the load station 108, transfer arm 130 holds the wafers while they are rinsed. After a thorough rinsing, the wafers are reloaded into cassettes 132, which then transport the subsequent stations for further processing or packaging.

During this polishing and planarization process, the polishing pad will wear and thus become less effective. Therefore, it is important to buff or condition polishing pad 126 to remove any surface irregularities that may develop during polishing. Generally, there are two ways to condition the polishing pad; in-situ and ex-situ conditioning. In-situ conditioning takes place during the wafer polishing process, while ex-situ conditioning occurs in between polishing steps.

Figure 4:
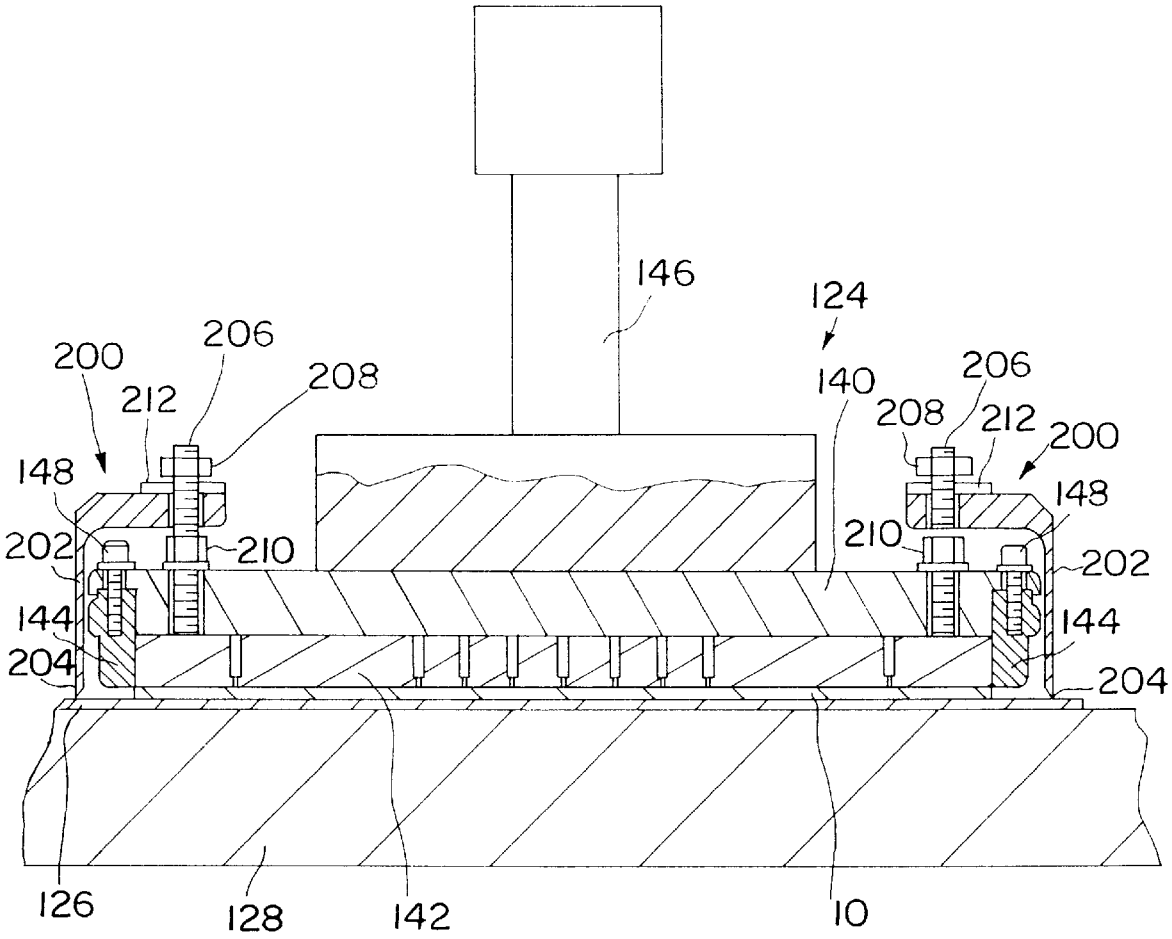
FIG. 4 is a side cross-sectional view of a semiconductor wafer carrier element with an in-situ polishing pad conditioning ring connected thereto.

Referring now to FIGS. 2–4, in-situ conditioning will first be discussed. In accordance with a preferred embodiment of the present invention, in-situ conditioning generally occurs by connecting an in-situ conditioning element 200 to each individual carrier element 124. Therefore, as carrier elements 124 rotate and move the wafers over the polishing pad, conditioning elements 200 will also contact the polishing pad, thus conditioning the pad while the wafers are being polished.

Referring now to FIG. 4, the configuration of conditioning element 200 and carrier element 124 will now be discussed. As previously mentioned, carrier element 124 holds and presses the wafers against the polishing pad during the polishing operation. As is well known in the art, carrier element 124 may comprise a number of different embodiments. However, for purposes of discussing the present invention, carrier element 124 will be discussed in accordance with the embodiment shown in FIG. 4.

In accordance with a preferred embodiment of the present invention, carrier element 124 preferably comprises a pressure plate 140, a protective layer 142, a retaining ring 144, and a rotation drive shaft 146. Pressure plate 140 applies an equally distributed downward pressure against the backside of a wafer 10 as it is pressed against polishing pad 126. Protective layer 142 will preferably reside between pressure plate 140 and wafer 10 to protect the wafer during the polishing process. Protective layer 142 may be any type of semi-rigid material that will not damage the wafer as pressure is applied; for example, a urethane-type material. Wafer 10 may be held against protective layer 142 by any convenient mechanism, such as, for example, by vacuum or by wet surface tension. Circular retaining ring 144 preferably is connected around the periphery of protective layer 142 and prevents wafer 10 from slipping laterally from beneath the protective layer as the wafer is polished. Retaining ring 144 is generally connected to pressure plate 140 by bolts 148.

Figure 6:
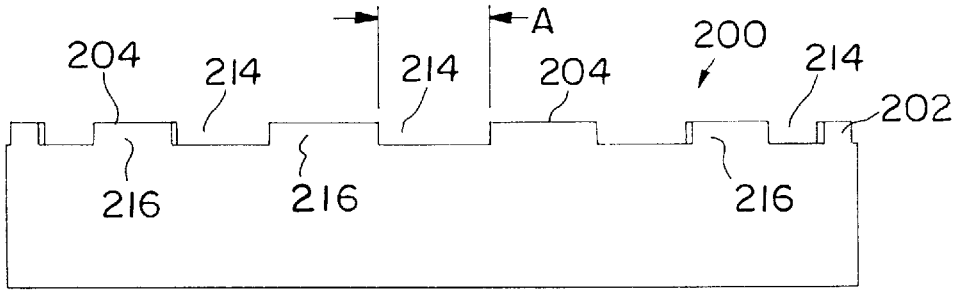
FIG. 6 is a side view of the in-situ conditioning ring shown in FIGS. 4 and 5.

Also connected to pressure plate 140 is conditioning element 200 which, in accordance with a preferred embodiment of the invention, is a ring formed of a rigid material, such as metal. As shown in FIGS. 4 and 6, conditioning element 200 preferably includes a downwardly extending flange 202 which terminates in a substantially flat bottom surface 204 having cutting elements 205 attached thereto. The flange 202 is of sufficient length so that bottom surface 204 with attached cutting elements 205 will contact the polishing pad during processing. Further, conditioning element 200 preferably will be loosely connected to pressure plate 140 by bolts 206. This relatively loose connection between pressure plate 140 and conditioning element 200 allows limited vertical movement but restricts lateral movement of conditioning element 200. The vertical movement of the conditioning element 200, which occurs between nuts 208 and 210 (FIG. 4), is permitted so that the cutting elements 205 contact pad 126 by virtue of the weight of conditioning element 200, rather than by pressure applied by carrier element 124. If needed, additional weighted rings 212 may be added to conditioning element 200 to increase the weight of the ring and thus the conditioning pressure on the pad.

Figure 5:
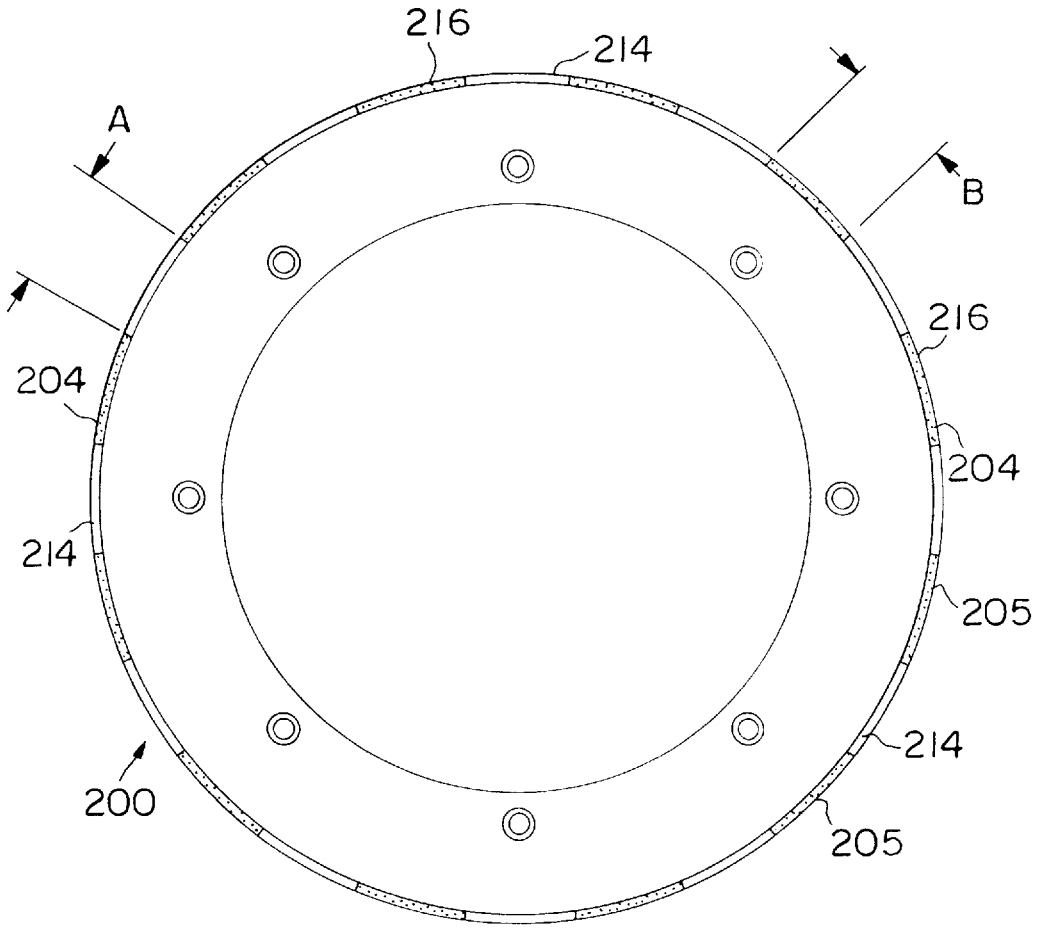
FIG. 5 is a top view of the in-situ polishing pad conditioning ring shown in FIG. 4.

In accordance with a further aspect of the preferred embodiment of the present invention, flange 202 may include cut out portions 214 which permit sworf and fluids to escape from the interior of conditioning element 200. Accordingly, as shown in FIGS. 5 and 6 as dimension "A", cut out portions 214 may be in the range about 0.75 to 1.25 inches and more preferably in the range of about 0.875 to 1.125 inches. The remaining portions of flange 202, which have cutting elements 205 attached thereto, are shown in FIGS. 5 and 6 as elements 216. The size of the remaining flange portions 216 are illustrated in FIG. 5 as dimension "B" and are in the range of about 0.75 to 1.25 inches and more preferably in the range of about 0.875 to 1.125 inches.

In accordance with yet another aspect of the present invention, cutting elements 205 may be any hard cutting material useful for conditioning pads, such as, for example, diamond particles, polycrystalline chips/slivers, cubic boron nitrite particles, silicon carbide particles, and the like. Further, cutting elements 205 may be secured to bottom surface 204 of flange 202 by a brazed bonding process which creates an extremely secure bond. This bonding process will be discussed in more detail below.

During operation of apparatus 100, wafer 10 held by carrier element 124 is brought into contact with polishing pad 126 which is secured to lap wheel 128. Preferably, to maximize polishing, an abrasive slurry is introduced between polishing pad 126 and wafer 10. Various types of abrasive slurries can be used, as is known in the art. As wafer 10 contacts pad 126, both lap wheel 128 and carrier element 124 rotate, thus facilitating the polishing and planarization of the wafer. In addition, as carrier element 124 lowers wafer 10 onto the pad, conditioning element 200, which is connected to carrier element 124, will be lowered into contact with the pad. As lap wheel 128 and carrier element 124 rotate, cutting elements 205 will rough-up and, thus, condition polishing pad 126 at the same time the wafers are being polished.

In accordance with an alternate embodiment of the present invention, the ex-situ conditioning device of apparatus 100 will now be discussed. As briefly mentioned above, ex-situ conditioning generally occurs between polishing steps. That is, after a set of wafers has been polished and removed from the polishing pad, a separate conditioning device is introduced against polishing pad 126 to condition the pad. It should be noted, however, that apparatus 100 does not have to utilize both in-situ and ex-situ conditioning. One skilled in the art will appreciate that apparatus 100 may include either in-situ conditioning or ex-situ conditioning, or apparatus 100 may include both.

Figure 7:
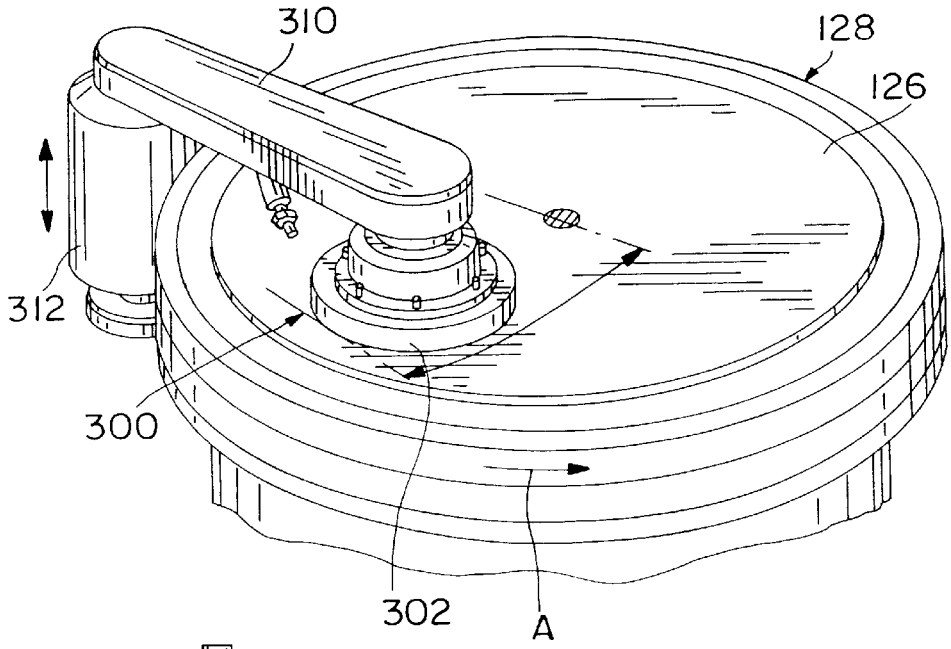
FIG. 7 is a perspective view of the polishing surface of the polishing machine shown in FIG. 1 with an ex-situ polishing pad conditioning apparatus in operative engagement with the polishing surface.
Figure 8:
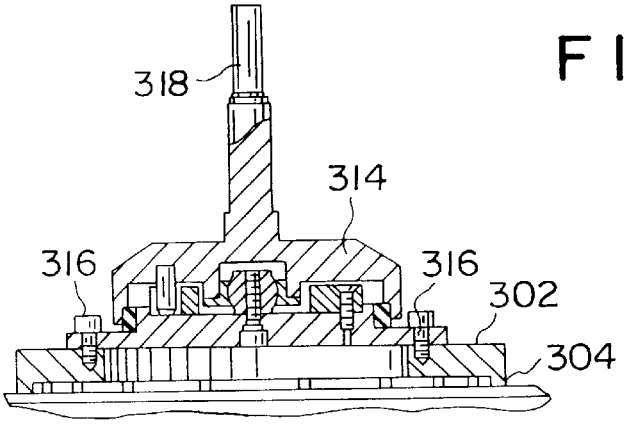
FIG. 8 is a side cross-sectional view of the ex-situ polishing pad conditioning ring holder shown in FIG. 7.
Figure 9:
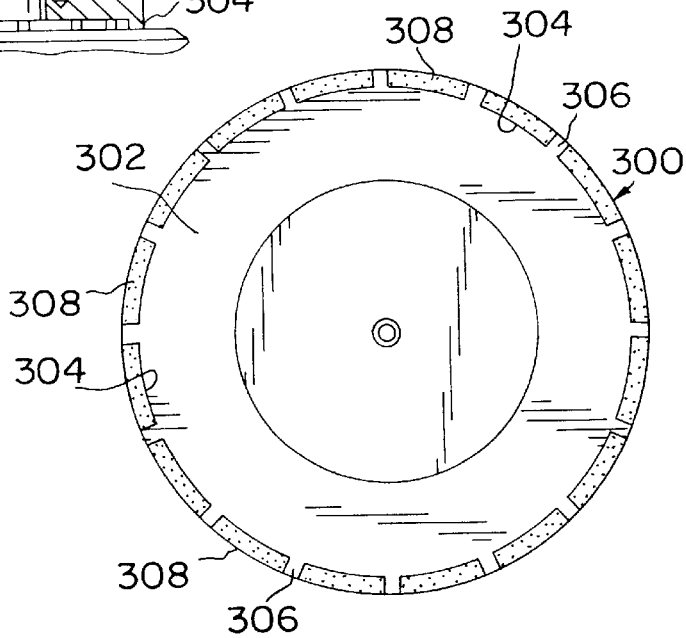
FIG. 9 is a top view of an ex-situ polishing pad conditioning ring.

Referring now to FIGS. 7–9, an ex-situ conditioning device 300 preferably comprises a circular conditioning ring carrier element 302 made of a rigid material, such as metal. In accordance with this aspect of the present invention, ring carrier element 302 preferably has a downwardly extending flange 304 which, during operation, will contact and condition the polishing pad. In accordance with a further aspect of this embodiment of the invention, flange 304 may be interrupted by a plurality of cutouts 306 which permits sworf and fluids to escape from the interior of conditioning device 300 during operation.

As with the in-situ conditioning ring and as illustrated in FIG. 9, cutting elements 308 may be secured to the bottom surface of flange 304. Similarly, cutting elements 308 may comprise a variety of materials, such as, for example, diamond particles, polycrystalline chips/slivers, cubic boron nitrite particles, silicon carbide particles, and the like. As discussed in detail below, cutting elements 308 may be attached to the bottom portion of flange 304 by a unique braze bonding process.

In accordance with this preferred embodiment of the invention, conditioning device 300 preferably is attached to an operating arm 310 which is configured to raise and lower conditioning device 300 into and out of engagement with polishing pad 126. The vertical movement of operating arm 310 is controlled by a pressure cylinder 312. In addition, operating arm 310 may also be adapted for moving conditioning device 300 back and forth across the top of pad 126, thus insuring that the entire top surface of the pad is conditioned equally. Various means may be employed to connect conditioning element 300 to operating arm 310. For example, as illustrated in FIG. 8, ring 302 may be secured to a bearing housing 314 by shoulder bolts 316. In accordance with this configuration, a shaft 318 may be configured to engage a chuck in the head of operating arm 310, thus holding the housing and ring assembly in operative engagement with the arm.

During processing, when it is desired to condition polishing pad 126, arm 310 is activated to bring conditioning device 300, and more particularly cutting elements 308, into contact with the top surface of polishing pad 126. In addition, lap wheel 128 rotates (e.g., counter-clockwise) and, at the same time, operating arm 310 oscillates causing conditioning element 300 to traverse back and forth across the surface of polishing pad 126. The downward pressure that the conditioning device exerts on the polishing pad surface and the length of time that the conditioning element is in contact with the pad may vary as necessary to achieve the desired conditioning results.

Figure 10:
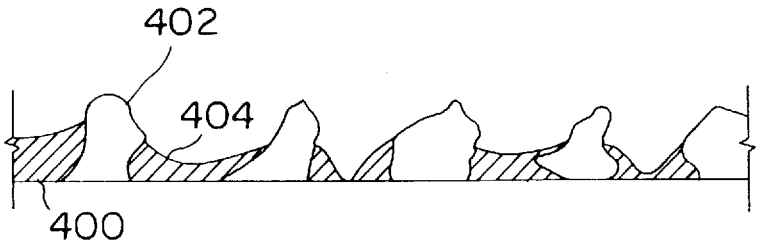
FIG. 10 is a cross-sectional view of cutting elements which have been braze bonded to a conditioning ring.
Figure 11:
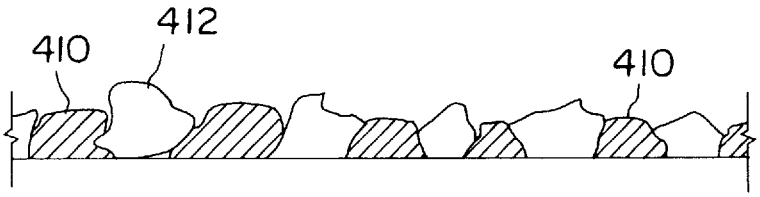
FIG. 11 is a cross-sectional view of cutting elements which have been electroplated to a conditioning ring.

Referring now to FIGS. 10 and 11, the subject method of attaching the cutting elements to the conditioning rings will now be discussed. In accordance with a preferred embodiment of the present invention, cutting elements 402 may be attached to a carrier ring 400 by a direct brazing technique which creates a very strong, reliable bond between the cutting elements and the ring surface. The brazing method of the present invention utilizes readily available, very hard and durable brazing alloys to create the secure bond. The brazing alloys utilized generally comprise nickel-chromium or cobalt-nickel-chromium combinations. It has been found that this family of brazing alloys creates superior chemical/mechanical bonds because the alloys tend to cling to the cutting element surfaces rather than flowing away from them during the treatment process. Thus, greater surface contact between the cutting elements and the alloy are achieved.

The process of bonding cutting elements 402 to the conditioning ring surface 400 will now be discussed. In accordance with one aspect of the present invention, cutting elements 402 and braze alloy particles 404 are suitably placed on the metal ring surface in a predetermined fashion. To hold the cutting elements and braze alloy particles in place, a temporary binding agent may be used, such as, for example, a resinous compound dissolved in a suitable organic solvent, or the like. Upon proper distribution of the cutting elements and alloy particles, the ring assembly is then placed in a furnace having a reducing atmosphere or vacuum and heated until the braze flows and wets the cutting elements and metal ring surface. Finally, the braze is cooled, securely bonding the cutting elements to the ring surface.

In accordance with another aspect of the present invention, the brazing process may be performed in two-steps rather than one as discussed above. In the two-step process, the brazing alloy is first applied to the ring surface in a manner similar to that described above, however, the cutting elements are not present. After the braze alloy is fused to the ring surface, the cutting elements are then attached to the layer of braze alloy on the ring surface by using a temporary binder. After the cutting elements are properly positioned, the ring assembly again is placed in the furnace until the braze remelts and surrounds the cutting elements. This two-step process generally achieves the same bonding strength as the one-step method, but the two-step process allows for greater control of surface uniformity of the cutting elements on the ring surface. A more detailed discussion of a brazing process useful in the context of the present invention is discussed in Lowder et. al., U.S. Pat. Nos. 3,894,673 and 4,018,576 issued on Jul. 15, 1975 and Apr., 19, 1977 respectively, both of which are incorporated herein by reference.

In accordance with a further aspect of the present invention, the subject process of braze bonding the cutting elements to the carrier ring surface exhibits superior performance compared to the conventional electroplating bond currently known in the art. Improvements such as the ability to control the amount of plating, the ability to control the amount and placement of the cutting elements on the ring, better adhesion of the cutting elements to the ring surface, the ability to have predictable and repeatable conditioning rings, and better pad management due to the control of the cutting elements, plating, and spacing of the elements are achieved. All such improvements are related to the fact that the invention provides for better bonding of the cutting elements to the conditioning ring surface with less bond metal than has been previously possible. In this regard, the brazing method provides optimal support for each and every cutting element on the ring because during the fusing process, the braze alloy encompasses the side and bottom surfaces of each element, thus forming the solid bond. This aspect of the invention is shown in FIG. 10 which depicts a cross-section of cutting elements 402 brazed to the surface of conditioning ring 400. The bond surface 404 is characterized as "concave," i.e., the alloy metal bond depth is at a minimum at a point intermediate adjacent elements. A cross-section of cutting elements electroplated to the conditioning ring in accordance with prior art techniques is shown in FIG. 11. As distinguished from FIG. 10, the surface contour of the bonding metal 410 is inherently convex in the electroplated device, thus providing minimal support for cutting elements 412 for a given depth of bond metal. Therefore, with the electroplating process, the bond is weaker even though more bond metal is used. In fact, as much as 50% to 100% of the cutting elements may be covered by the bond metal with the electroplating process. However, with the braze process, the cutting elements can be bonded with as little as 25% to 40% of the cutting element being covered with bond, therefore allowing greater sworf clearance, faster cutting and reduced heat build up.

In accordance with a further aspect of the present invention, cutting elements having an aspect ratio in the range of 0.5:1.0 to 1.5:1.0, and most preferably about 1.0:1.0 are suitably employed; that is, in a particularly preferred implementation of the present invention, the height of the cutting elements is approximately equal to the width of the cutting elements. In this way, the effectiveness of the subject bonding technique, as well as the effectiveness of the various cutting elements in the pad dressing operation are substantially independent of the orientation of the cutting elements.

It should be noted, that this braze bonding process can be used to attach cutting elements exhibiting different material properties. For example, as discussed above, cutting elements may comprise diamond particles, polycrystalline chips/slivers, cubic boron nitrite particles, silicon carbide particles, and the like. However, for conditioning semiconductor wafer polishing pads, diamond and cubic boron nitrite particles are preferred.

It will be understood that the foregoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

We claim:

1. An apparatus for conditioning a polishing pad while workpieces are being polished on said polishing pad, said apparatus comprising:

a carrier element configured to carry a workpiece, said carrier element comprising a pressure plate configured to press a surface of said workpiece against said polishing pad during processing; and means for conditioning said polishing pad, said means for conditioning being coupled to said carrier element and located around the periphery of said pressure plate, said means for conditioning comprising a flange having a substantially flat bottom surface and a plurality of cutting elements braze bonded to said bottom surface.

2. The apparatus recited in claim 1, wherein said flange includes a plurality of cutouts formed therein to permit materials to escape from the interior of the ring.

3. The apparatus recited in claim 1, wherein said cutting elements are substantially uniformly distributed on said flange.

4. The apparatus recited in claim 1, wherein said cutting elements are braze bonded to said flange with a brazed metal alloy, wherein the height of said brazed metal alloy extending from said flange is between about 25% to about 40% of the height of said cutting elements.

5. The apparatus recited in claim 1, wherein said cutting elements are permanently brazed to said flange.

6. The apparatus recited in claim 1, wherein said cutting elements comprise diamond particles.

7. The apparatus recited in claim 1, wherein said cutting elements are braze bonded to said flange with a brazed metal alloy, wherein the height of said brazed metal alloy extending from said flange is less than about 50% of the height of said cutting elements.

* * * * *